US007401440B2

(12) United States Patent
Hauck

(10) Patent No.: US 7,401,440 B2
(45) Date of Patent: Jul. 22, 2008

(54) LARGE, TRANSPORTABLE ARCUATE ARCHITECTURAL COMPONENTS

(76) Inventor: Robert F. Hauck, 13555 Depot St., #E, San Martin, CA (US) 95046

( * ) Notice: Subject to any disclaimer, the term of this patent is extended or adjusted under 35 U.S.C. 154(b) by 715 days.

(21) Appl. No.: 10/811,689

(22) Filed: Mar. 29, 2004

(65) Prior Publication Data

US 2004/0187403 A1 Sep. 30, 2004

Related U.S. Application Data

(60) Provisional application No. 60/459,237, filed on Mar. 29, 2003.

(51) Int. Cl.
*E04B 1/32* (2006.01)

(52) U.S. Cl. ..... 52/80.1; 52/86; 52/539; 52/589.1; 52/212; 52/245

(58) Field of Classification Search ..... 52/80.1, 52/86, 746.12, 539, 731.2, 731.3, 211, 212, 52/589.1, 5, 81.2, 81.4, 81.6, 88, 246, 245, 52/247, 595.2, 592.6
See application file for complete search history.

(56) References Cited

U.S. PATENT DOCUMENTS 1,762,363 A * 6/1930 Sergent ..... 52/86
1,817,619 A * 8/1931 Greenwald ..... 52/31
2,181,164 A 11/1939 Alexander
2,187,404 A * 1/1940 Simons et al. ..... 52/534
2,253,219 A 8/1941 Alexander
3,008,273 A 11/1961 Widin
3,206,888 A 9/1965 Litzka
3,413,774 A 12/1968 Oberreich
3,421,269 A 1/1969 Medow
3,488,965 A * 1/1970 Chesnov ..... 405/151
3,511,006 A 5/1970 Medow
3,971,176 A 7/1976 Rannels
4,873,796 A * 10/1989 Akmese ..... 52/81.4
5,232,762 A 8/1993 Ruby
5,291,717 A * 3/1994 Turner ..... 52/745.07
5,572,834 A 11/1996 Lilly
5,590,493 A * 1/1997 Wilson ..... 52/108
5,618,601 A 4/1997 Ruby
5,671,583 A 9/1997 Turner (Continued)

*Primary Examiner*—Richard E. Chilcot, Jr.
*Assistant Examiner*—Mark R Wendell
(74) *Attorney, Agent, or Firm*—Donald E. Schreiber

(57) ABSTRACT

An arcuate component includes, a flexible outer board, a flexible inner board and both a first and a second plurality of arcuate tiles. Tongue and groove tracks formed along opposite longitudinal edges of the outer and inner boards lock with mating arcuate tongue-and-groove edges of the arcuate tiles which respectively span between the outer and inner boards. The arcuate tiles also preferably include at least one tongue-and-groove that spans between the outer and inner boards and that mates and locks with a tongue-and-groove formed on an immediately adjacent tile. A series of slots cut across the outer and inner boards between their longitudinal edges increases their flexibility. The mated arcuate tiles constrain the outer and inner boards into an arcuate shape. Alternatively, tongue-and-groove tracks formed along opposite longitudinal edges of a plurality of boards mate to form a cylindrically shaped arcuate architectural component such as a column. A series of slots cut along boards forming a column parallel to the board's longitudinal edges increase their flexibility.

19 Claims, 10 Drawing Sheets

U.S. PATENT DOCUMENTS 5,699,637 A * 12/1997 Marocco ..... 52/204.53
5,815,990 A * 10/1998 Barry et al. ..... 52/80.1
5,816,013 A 10/1998 Opferbeck et al.
5,824,382 A 10/1998 Ruby
5,941,027 A * 8/1999 Hallsten ..... 52/64
5,987,845 A * 11/1999 Laronde ..... 52/731.2
6,094,877 A * 8/2000 White ..... 52/247
6,247,286 B1 * 6/2001 Heyns ..... 52/589.1
6,308,490 B1 * 10/2001 Saebi ..... 52/745.07
2003/0046881 A1 3/2003 Smerud
2004/0211128 A1 * 10/2004 Turner ..... 52/80.1

* cited by examiner

LARGE, TRANSPORTABLE ARCUATE ARCHITECTURAL COMPONENTS

CLAIM OF PROVISIONAL APPLICATION RIGHTS

This application claims the benefit of U.S. Provisional Patent Application No. 60/459,237 filed on Mar. 29, 2003.

BACKGROUND OF THE INVENTION

1. Field of the Invention

The present invention relates generally to large curved or arcuate structures that are frequently associated with buildings, and more particularly to methods and constructions that facilitate their erection.

2. Description of the Prior Art

Outdoor architectural structures such as arbors, gazebos, patio-covers, pergolas, etc. are frequently associated with buildings such as homes. For aesthetic reasons, these structures frequently include large curved or arcuate components whose fabrication is significantly more difficult at a building site. Unfortunately, in many instances these curved or arcuate components of such structures, when finished, are too large to be easily transported on public streets and highways from a factory where they are built to a location where they are placed in service. Consequently, large curved or arcuate components when too large for transportation on public streets and highways must be fabricated on-site. On-site fabrication of a large structure having curved or arcuate components generally, if not always, increases the cost of its erection in comparison with its fabrication at a factory followed by shipping of the finished structure to the location where it will be used. Consequently, there presently exists a need for a method and construction that facilitates erecting structures having large curved or arcuate components more economically while concurrently preserving the structure's appearance.

Presently, a solid plastic, wood-alternative material made from 100% recycled polyethylene plastic obtained from soda bottles, detergent bottles, and milk containers is available from a number of different manufacturers. This solid plastic, wood-alternative material is strong, impact resistant, and "wood-like" in appearance. Furthermore, this material is maintenance free, and needs no painting or superficial maintenance. Similar to wood, the solid plastic, wood-alternative material can be cut, drilled, mitered, routered, and sanded with conventional woodworking tools.

One characteristic of the solid plastic, wood-alternative material, in comparison with most types of natural wood used in fabricating outdoor architectural structures having curved or arcuate components such as arbors, gazebos, etc., is that it has slightly less mechanical rigidity. However, because in many instances mechanical requirements of such structures are moderate or may be accommodated by an appropriate design or hidden structural supports, the solid plastic, wood-alternative material's lesser mechanical rigidity does not prevent its use in such structures.

BRIEF SUMMARY OF THE INVENTION

An object of the present invention is to provide an improved method and construction for structures which include large curved or arcuate components.

Another object of the present invention is to provide a method and construction for structures which include large curved or arcuate components that are adapted for use with solid plastic, wood-alternative materials.

An object of the present invention is to provide a simpler method and construction for structures which include large curved or arcuate components.

An object of the present invention is to provide a more economical method and construction for structures which include large curved or arcuate components.

Briefly, the present invention in one embodiment is an architectural structure that includes an arcuate component. The arcuate component includes:

1. a flexible outer board;
2. a flexible inner board;
3. a first plurality of arcuate tiles; and
4. a second plurality of arcuate tiles.

The flexible outer board, which includes tongue and groove tracks formed along its opposite longitudinal edges, upon being bent forms a curved first outer surface of the arcuate component. Similarly, the flexible inner board, which also includes tongue and groove tracks formed along its opposite longitudinal edges, upon being bent forms a curved second outer surface of the arcuate component. A series of slots cut across the outer and inner boards between their longitudinal edges increases their flexibility to facilitate on-site assembly of the arcuate component.

The first plurality of arcuate tiles is adapted to be arranged for forming a third outer surface of the arcuate component which spans between a longitudinal edge of the flexible outer board and a longitudinal edge of the flexible inner board. The second plurality of arcuate tiles are also adapted to be arranged for forming a fourth outer surface of the flexible outer board which spans between a longitudinal edge of the flexible outer board and a longitudinal edge of the flexible inner board.

Peripheral edges of the first and second pluralities of arcuate tiles have formed therealong:

1. an arcuate first tongue-and-groove that is adapted to mate and lock with a portion of the tongue-and-groove track of the flexible outer board;
2. an arcuate second tongue-and-groove that is adapted to mate and lock with a portion of the tongue-and-groove track of the flexible inner board; and
3. at least one third tongue-and-groove that is adapted to mate and lock with a tongue-and-groove formed on another one of the arcuate tiles that is located immediately adjacent to the tile.

Thus, mating and locking tongue-and-grooves of the first and second pluralities of arcuate tiles with the tongue-and-groove tracks of the flexible outer board, the flexible inner board and with each other respectively forms the third and fourth outer surface of the arcuate component. Furthermore, the mated pluralities of arcuate tiles constrain the mating tongue-and-groove tracks of the flexible outer and inner boards into an arcuate shape.

In another embodiment, tongue-and-groove tracks are again formed along its opposite longitudinal edges of a plurality of boards. However, in this other embodiment the series of slots are cut along the boards parallel to their longitudinal edges to increase their flexibility. In this embodiment, mating of the tongue-and-groove tracks for the plurality of boards permits assembling a large cylindrically shaped curved or arcuate architectural components such as a column.

An advantage of the present invention is that, except for final assembly, the component elements disclosed herein may be completely fabricated at a factory, and all the components be bundled flat until final on-site assembly. Thus, methods and constructions of the present invention advantageously facilitate erecting architectural structures that include large curved or arcuate components.

These and other features, objects and advantages will be understood or apparent to those of ordinary skill in the art from the following detailed description of the preferred embodiment as illustrated in the various drawing figures.

DETAILED DESCRIPTION

Figure 1A:
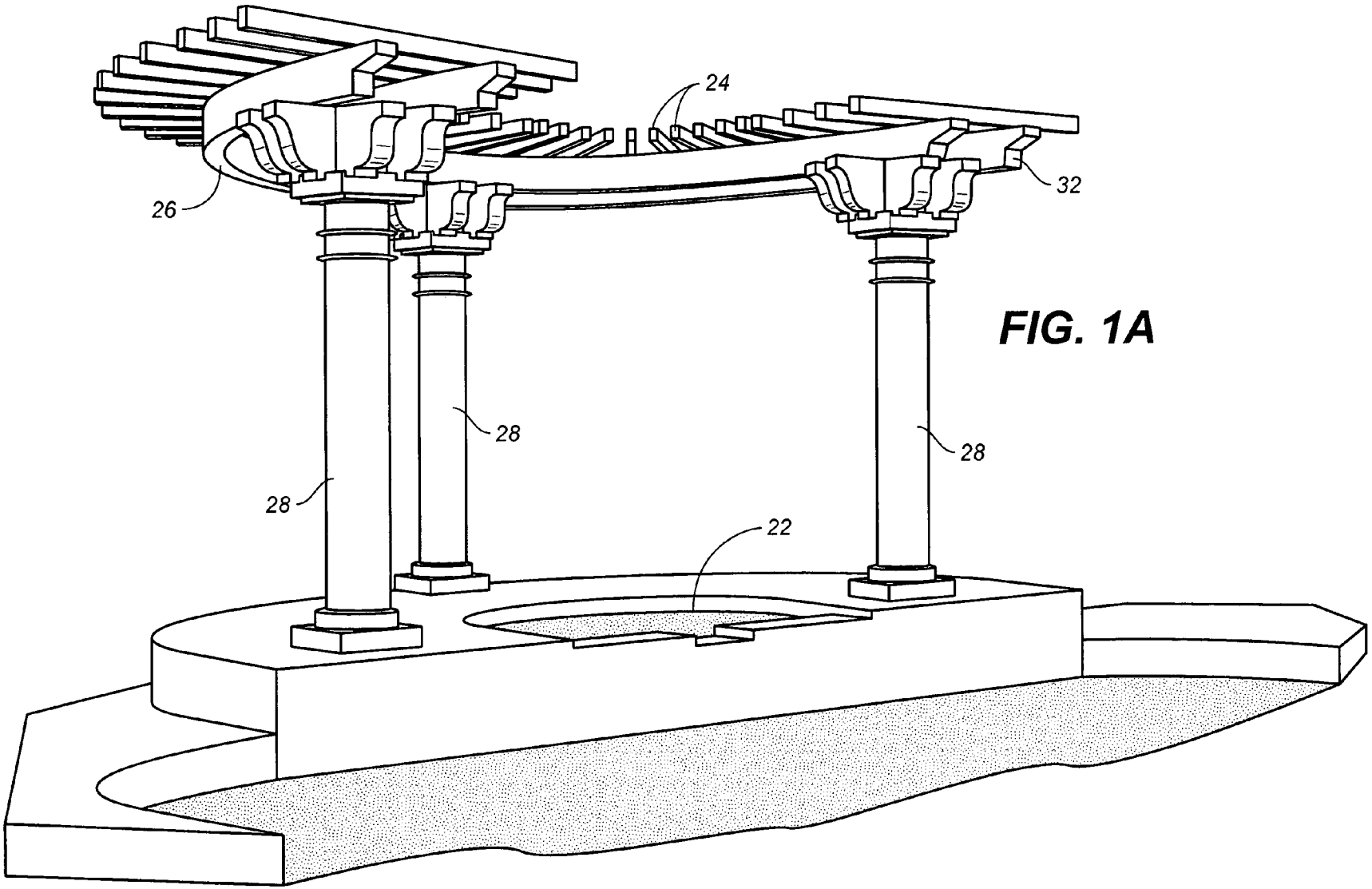
FIGS. 1A and 1B are perspective views illustrating an architectural structure, i.e. an arbor, that includes large, arcuate beams, and arcuate columns.
Figure 1B:
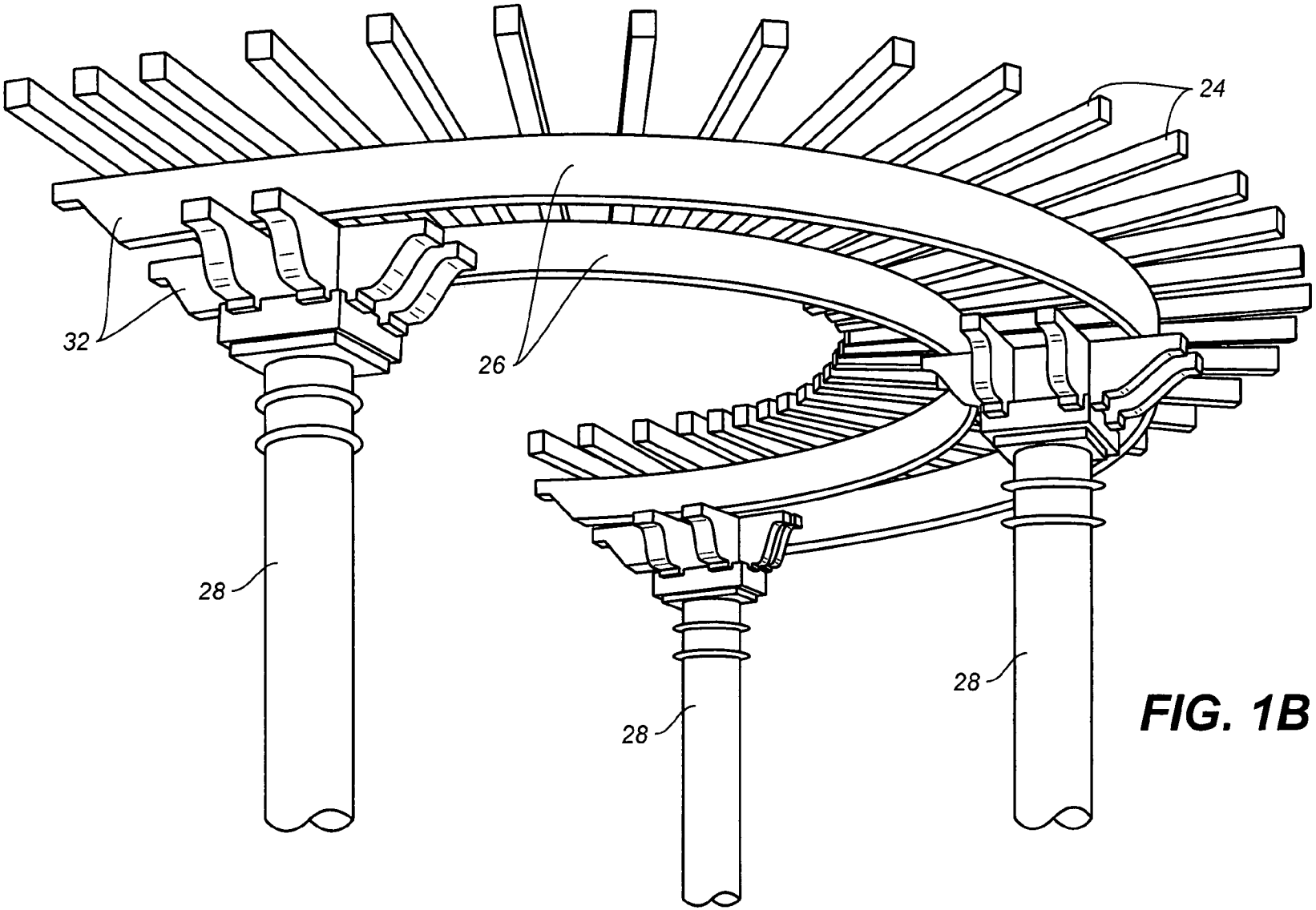

FIGS. 1A and 1B illustrate a horseshoe-shaped spa 22 above which stands a horseshoe-shaped arbor 24 that includes a pair of large, arcuate architectural components, i.e. a pair of nested horseshoe-shaped beams 26. The horseshoe-shaped beams 26 are supported above the horseshoe-shaped spa 22 by three circularly-shaped columns 28. Both ends of each of the horseshoe-shaped beams 26 includes butt ends 32. The distance between the butt ends 32 of the outer horseshoe-shaped beam 26 is approximately thirteen and one-half (13½) ft. The horseshoe-shaped beams 26 are so large that transporting them on public streets and highways from a factory where they are assembled to the construction site, i.e. to the horseshoe-shaped spa 22, is difficult, or perhaps, depending upon local conditions, in some instances impossible since many overpasses customarily allow only eleven feet eight inch (11'8") clearance.

In accordance with the present invention, the horseshoe-shaped beams 26 depicted in FIGS. 1A and 1B are respectively assemblable at a construction site from an easily transported kit of components that are depicted in FIGS. 2, 3, 4, 5A and 5B. The transportable kit of components used to assemble horseshoe-shaped beams 26 at the construction site includes:

1. a flexible outer board 42;
2. a flexible inner board 44;
3. a first plurality of arcuate tiles 46;
4. a second plurality of arcuate tiles 48; and
5. butt ends 32 that are formed by a combination of the boards and arcuate tiles 42, 44, 46, 48.

Figure 2:
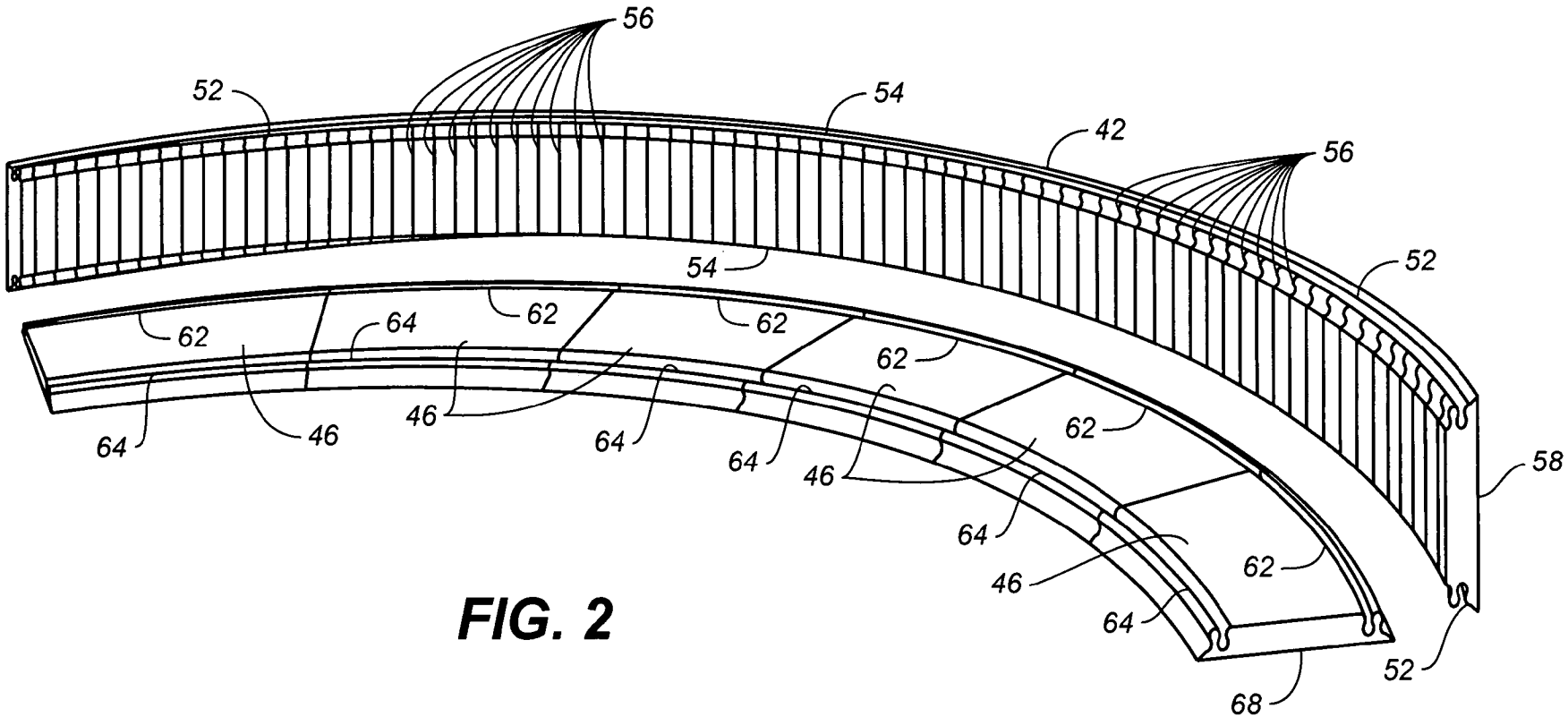
FIG. 2 is a perspective view illustrating a flexible outer board and a set of arcuate tiles that, in accordance with the present invention, are included in the large, arcuate beams pictured in FIGS. 1A and 1B.
Figure 3:
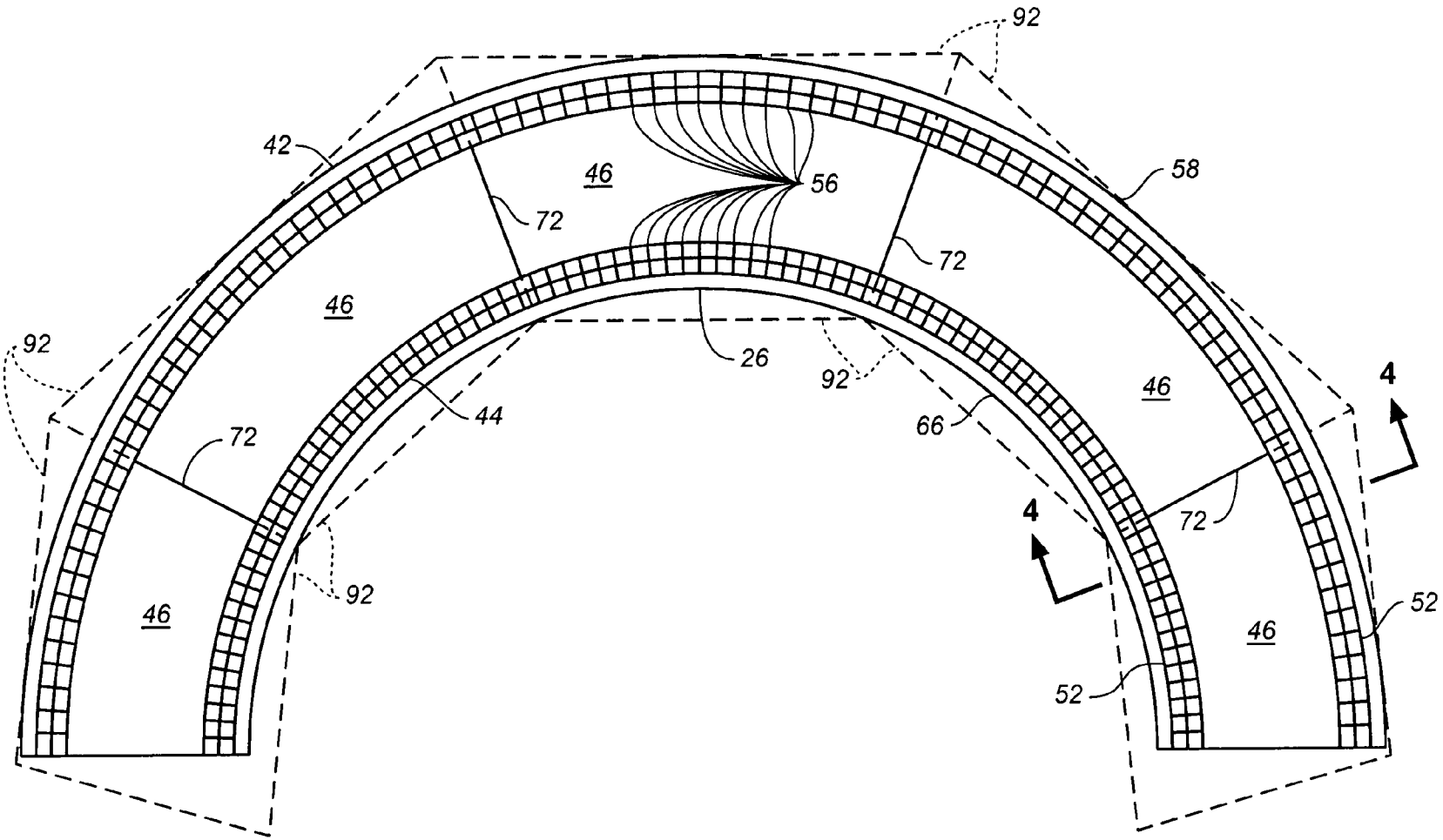
FIG. 3 is a plan view illustrating the flexible outer board and the set of arcuate tiles depicted in FIG. 2 together with a flexible inner board.

As illustrated in FIGS. 2 and 3, the flexible outer board 42 includes a pair of tongue-and-groove tracks 52 routed along opposite longitudinal edges 54 of the flexible outer board 42. A series of serrulate slots 56 cut across the flexible outer board 42 between the longitudinal edges 54, preferably perpendicular thereto, that extend well into but not through the flexible outer board 42 markedly facilitate the bending of the flexible outer board 42. Upon being bent as illustrated in FIGS. 2 and 3, the flexible outer board 42 forms a curved first outer surface 58 of the horseshoe-shaped beam 26.

As best illustrated in FIG. 2, each of the arcuate tiles 46 includes an arcuate tongue-and-groove 62 that is adapted to mate and lock with a portion of one of the tracks 52 of the flexible outer board 42. Each of the arcuate tiles 46 also includes an arcuate second tongue-and-groove 64 that is adapted to mate and lock with a portion of one a pair of tongue-and-groove tracks 52 routed along longitudinal edges 54 of the flexible outer board 42, not depicted in FIG. 2 but depicted in FIG. 3.

The flexible inner board 44, similar to the flexible outer board 42, includes a pair of tongue-and-groove tracks 52 routed along opposite longitudinal edges 54 thereof. The flexible inner board 44 also includes a series of slots 56 cut between the longitudinal edges 54, preferably perpendicular thereto, that extend well into but not through the flexible inner board 44 which markedly facilitate bending the flexible inner board 44. Upon being bent as illustrated in FIG. 3, the flexible inner board 44 forms a curved inner surface 66 of the horseshoe-shaped beam 26. Both the flexible outer board 42 and the flexible inner board 44 are preferably formed from the solid plastic, wood-alternative material that is made from 100% recycled polyethylene plastic. The solid plastic, wood-alternative material is preferred because it is:

1. more flexible, i.e. less rigid, than most natural woods;
2. homogeneous, i.e. lacks any grain along which it may possibly split; and
3. free from any induced force which opposes the natural counter-bending force inherent to the material.

Figure 4:
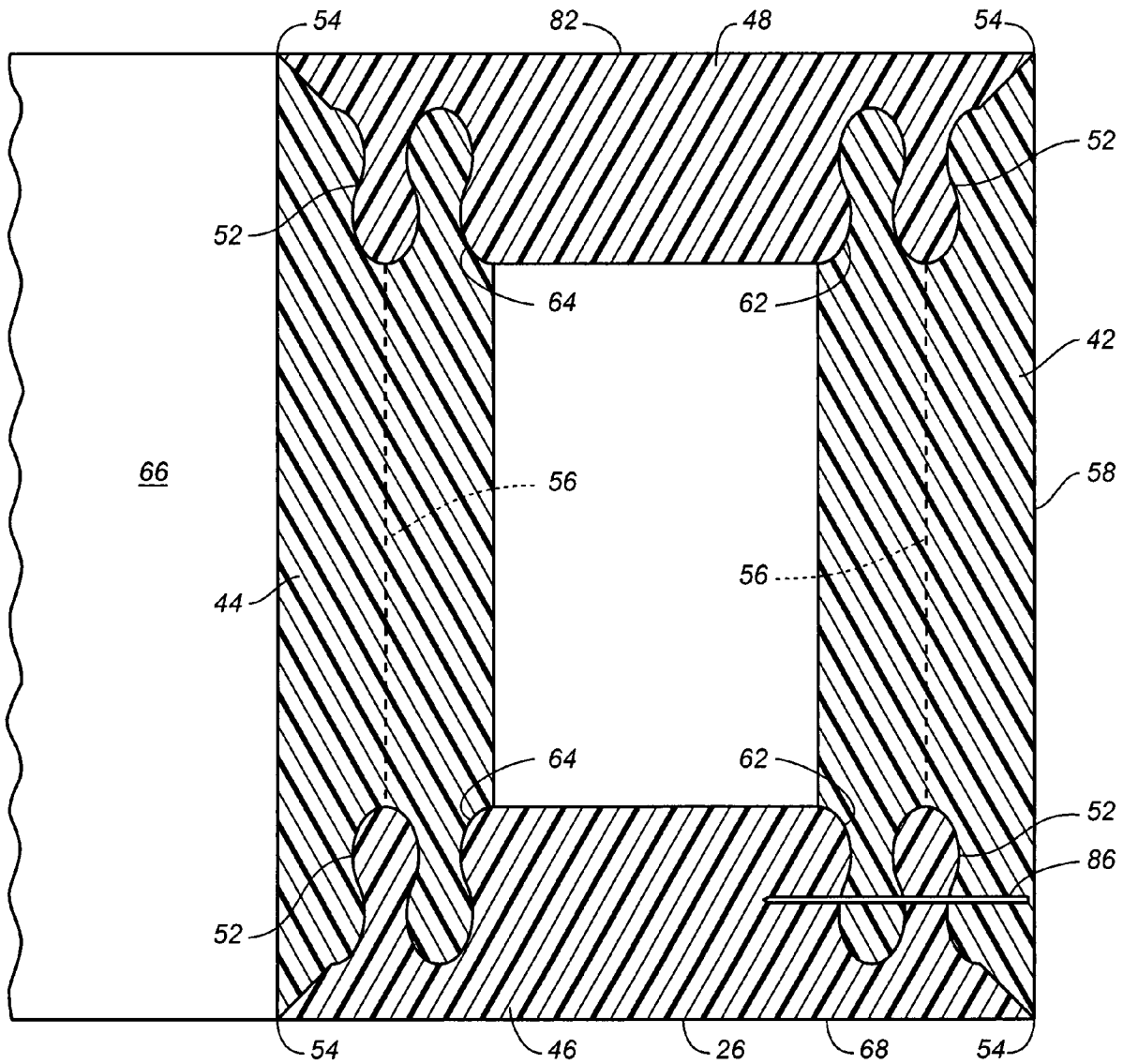
FIG. 4 is a cross-sectional elevational view taken along the line 4-4 in FIG. 3 illustrating the flexible outer and inner boards depicted in FIG. 3 together with two sets of arcuate tiles after being assembled to form one of the large, arcuate beams depicted in FIG. 1A and 1B.
Figure 5A:
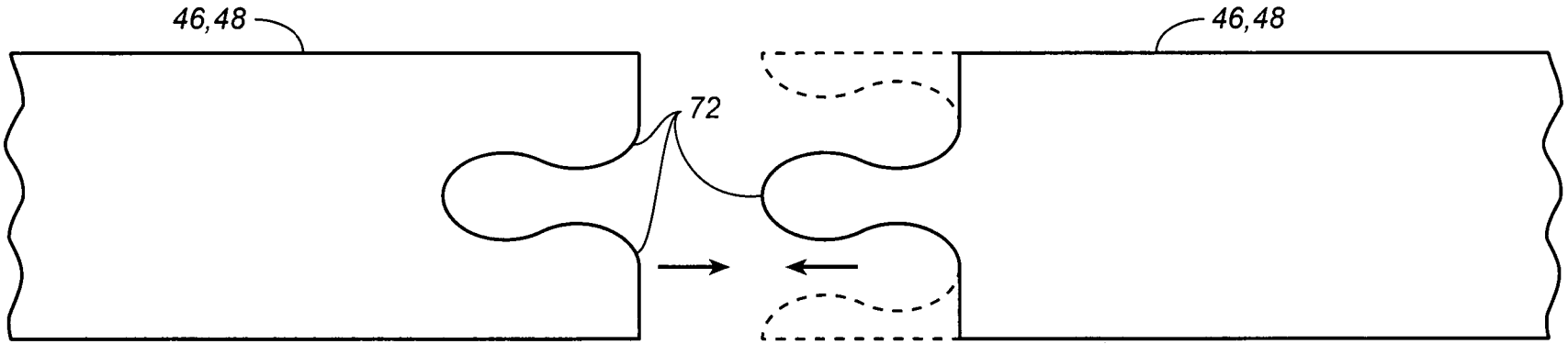
FIGS. 5A and 5B are a plan views that illustrate mating of tongue-and-groove peripheral edges of two immediately adjacent tiles such as those depicted in FIG. 3.
Figure 5B:
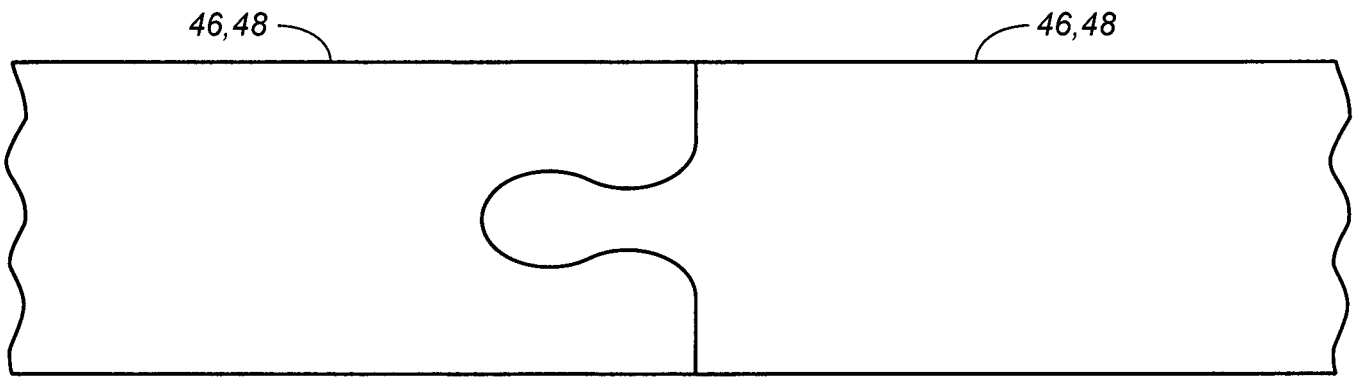

The plurality of arcuate tiles 46 depicted in FIGS. 2 and 3 are adapted to be arranged to form another outer surface 68 of the horseshoe-shaped beam 26. As illustrated in FIG. 4, when so arranged the arcuate tiles 46 span between a longitudinal edge 54 of the flexible outer board 42 and a corresponding longitudinal edge of the flexible inner board 44. To permit the plurality of arcuate tiles 46 to form a smooth, continuous outer surface 68, as illustrated in FIGS. 5A and 5B juxtaposed edges of immediately adjacent pairs of arcuate tiles 46 include mating tongue-and-grooves 72. As depicted in FIG. 2-4, mating of the tongue-and-grooves 72 for all the adjacent pairs of arcuate tiles 46 establishes the smooth, continuous outer surface 68. Upon mating all the first tongue-and-grooves 62 and second tongue-and-grooves 64 formed on peripheral edges of the plurality of arcuate tiles 46 with the tracks 52 respectively of the flexible outer and inner boards 42, 44, the arcuate tiles 46 constrain the tracks 52 of the flexible outer and inner boards 42, 44 to curve in the final arcuate shape of the horseshoe-shaped beam 26.

The plurality of arcuate tiles 48 are preferably fabricated as a mirror image of the arcuate tiles 46 with respect to the flexible outer and inner boards 42, 44. Consequently, when all the first tongue-and-grooves 62 and second tongue-and-grooves 64 formed on peripheral edges of the plurality of arcuate tiles 48 are mated with the tracks 52, respectively, of the flexible outer and inner boards 42, 44, the arcuate tiles 46 also constrain the tracks 52 thereof to curve in the final arcuate shape of the horseshoe-shaped beam 26, and form yet another outer surface 82 of the horseshoe-shaped beam 26.

Arranged in this way, as depicted in FIG. 4 the flexible outer and inner boards 42, 44 and the arcuate tiles 46, 48 form the arcuate shape of the horseshoe-shaped beam 26. The flexible outer and inner boards 42, 44 and the arcuate tiles 46, 48 enclose a hollow space within the horseshoe-shaped beam 26 which may, if desired, enclose reinforcing structural elements. Two (2) inch long galvanized brads 86 spaced at various locations along the length of the flexible outer and inner boards 42, 44 pierce tracks 52 mated respectively with tongue-and-grooves 62, 64 lock them together to prevent their separation.

Referring again to FIG. 3, dashed lines 92 indicate outlines of longitudinal edges of individual pieces of the solid plastic, wood-alternative material from which individual arcuate tiles 46, 48 are cut. Because the mating tongue-and-grooves 72 must be routed into juxtaposable edges of immediately adjacent pairs of the arcuate tiles 46, 48, the individual pieces of the solid plastic, wood-alternative material are initially longer and wider than those depicted in FIG. 3. After cutting the individual pieces of the solid plastic, wood-alternative material, both the arcuate tongue-and-grooves 62, 64 and the tongue-and-grooves 72 are routed to form the peripheral edges of the arcuate tiles 46, 48.

Figure 6A:
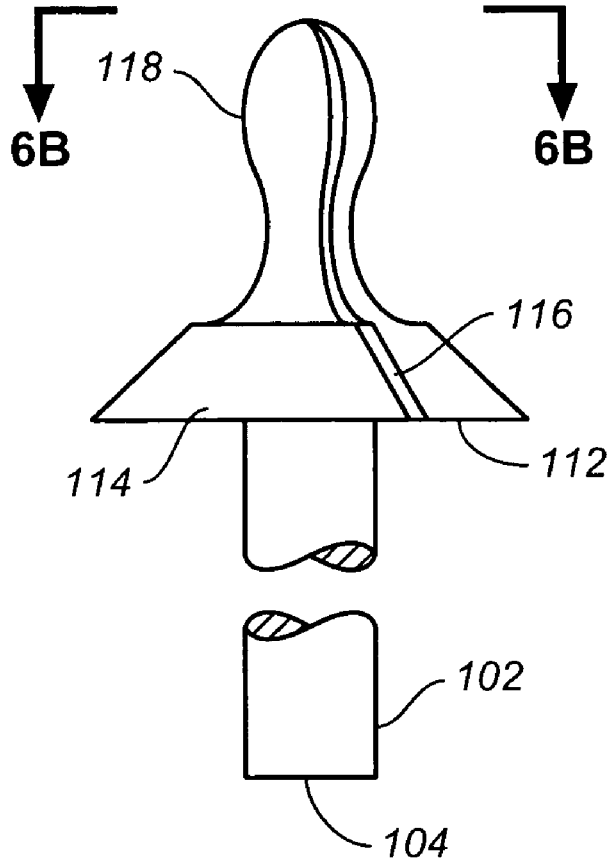
FIG. 6A is an elevational view that illustrates a router bit having a shape preferred for forming the tongue-and-groove tracks along the outer and inner boards, and tongue-and-grooves along all peripheral edges of arcuate tiles.
Figure 6B:
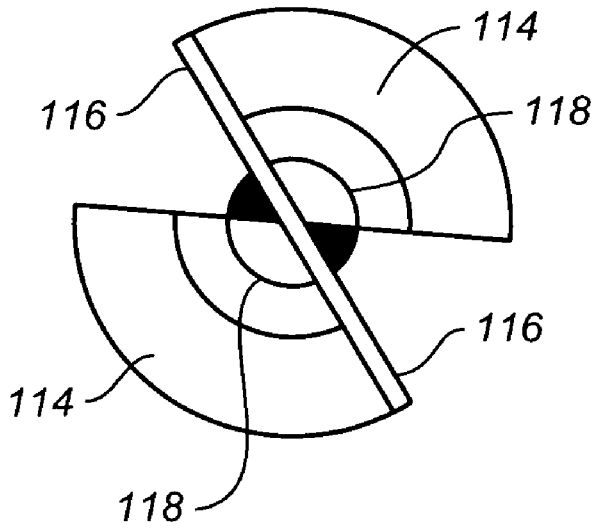
FIG. 6B is a plan view taken along the line 6B-6B in FIG. 6A illustrating a curved cutting end of the router.

FIGS. 6A and 6B depict a one-piece router bit 102 having a shape preferred for forming the tongue-and-groove tracks 52 along longitudinal edges 54 of the flexible outer and inner boards 42, 44, and the tongue-and-grooves 62, 64, 72 along all peripheral edges of the arcuate tiles 46, 48. Starting from the bottom, the router bit 102 includes a one-half (½) inch diameter, cylindrically-shaped shaft 104 adapted to be received into a chuck of a router. The shaft 104 ends at a one and five-eighth (1-⅝) inch diameter base 112 of a taper cutter 114 included in the router bit 102. The base 112 is oriented perpendicularly to the shaft 104. The taper cutter 114, which is shaped as the frustum of a cone, is one-half (½) inch thick and includes a sloping cutter surface 116 which inclines at an angle of 45° with respect to the base 112. Inclination of the cutter surface 116 at an angle of 45° forms a beveled edge along the various tongue-and-grooves 52, 62, 64, 72 that leaves finished edges on exterior surfaces of the horseshoe-shaped beam 26 after it has been assembled from the boards and arcuate tiles 42, 44, 46, 48.

On the other side of the taper cutter 114 from the shaft 104, the router bit 102 includes a one and one-eighth (1-⅛) long curved cutter 118 having an exterior surface formed in an S-curve shape. The S-curve shape of the curved cutter 118 immediately adjacent to the taper cutter 114 is a mirror image of the S-curve shape furthest from the taper cutter 114. Shaped in this way, the end of the curved cutter 118 furthest from the taper cutter 114 forms a groove which is adapted to receive a projecting tongue of the tongue-and-groove tracks 52, and of the tongue-and-grooves 62, 64, 72. All of the tongue-and-groove tracks 52, and the tongue-and-grooves 62, 64, 72 are formed using only the curved cutter 118. The various dimensions recited above for the router bit 102 adapt it for use with wood-alternative material having a nominal thickness of two (2) inches.

In fabricating the arcuate tiles 46, 48, after forming the projecting tongues of the tongue-and-grooves 72 using the router bit 102, excess material indicated by dashed lines in FIG. 5A must be cut from the arcuate tiles 46, 48 both below and above each projecting tongue. Similarly, after shaping the curved tongue-and-grooves 62, 64 using the router bit 102, excess material at the outer edges of the curved tongue-and-grooves 62, 64 is removed using a conventional 45° router bit similar to removal of the material on either side of the projecting tongue indicated in FIG. 5A.

Figure 7:
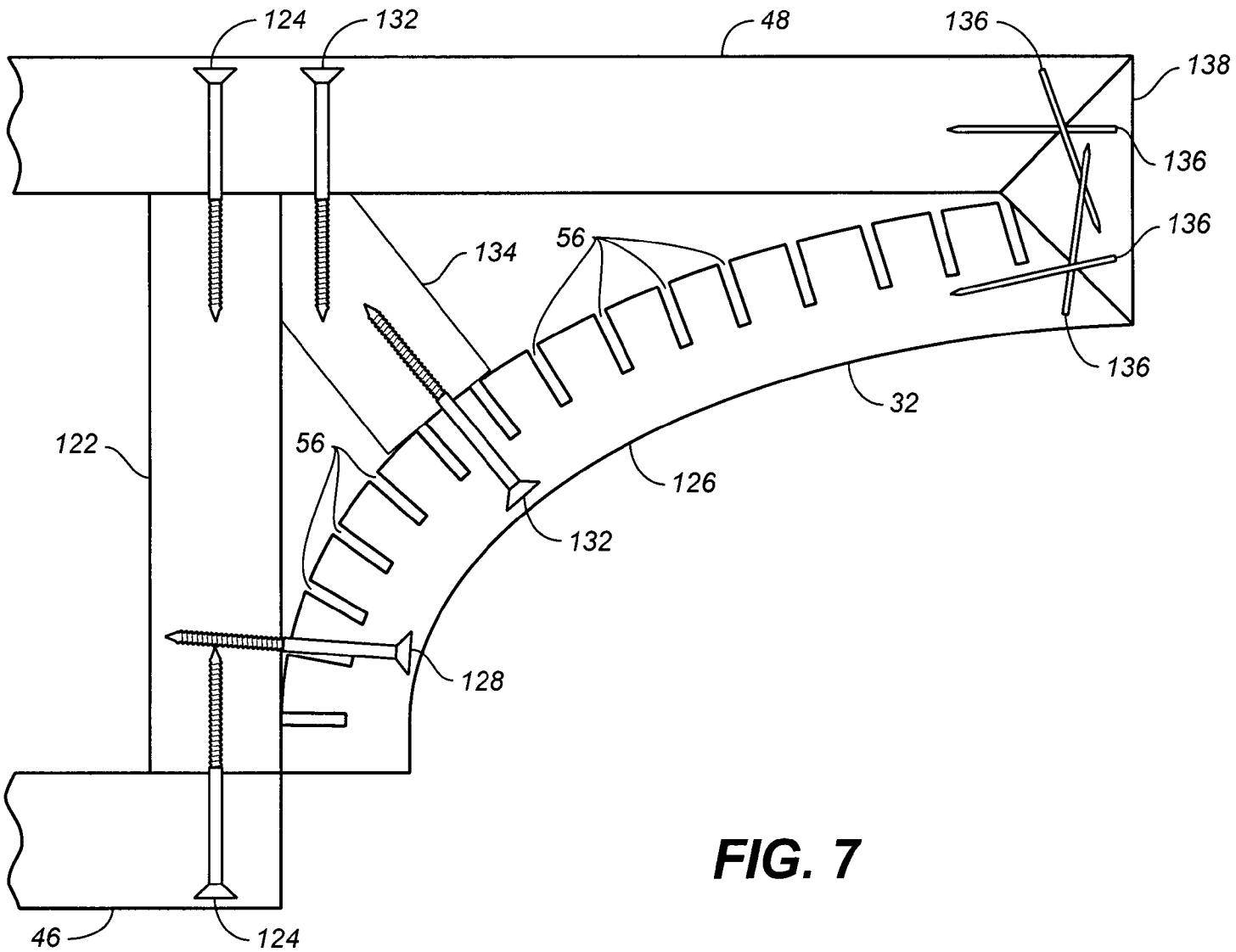
FIG. 7 is a cut-away elevational view that illustrates a preferred construction for butt ends included in the large, arcuate beams pictured in FIGS. 1A and 1B.

FIG. 7 depicts a preferred construction for butt ends 32 of the horseshoe-shaped beams 26 that are assembled using the wood-alternative material. As depicted in FIG. 7, each butt end 32 includes a block 122 which fills empty space between a shorter end of one arcuate tile 46 and a projecting end of another arcuate tile 48. Opposite ends of the block 122 are secured to the arcuate tiles 46, 48 by a pair of three (3) inch long Dacronite screws 124. A curved piece 126 of the wood-alternative material having slots 56 cut thereacross spans between a base of the block 122 at the arcuate tile 46 and a projecting end of the arcuate tile 48. The curved piece 126 is secured to the block 122 at the arcuate tile 46 by a pair of three (3) inch long Dacronite screws 128. A pair of three (3) inch long Dacronite screws 132 also secure a pointed block 134 between the curved piece 126 and a V-shaped juncture between the block 122 and the arcuate tile 48. Lastly, pairs of two (2) inch long galvanized brads 136 secure a triangularly-shaped block 138 into a V-shaped groove that is formed by juxtaposed ends of the arcuate tile 48 and curved piece 126. Though not illustrated in FIG. 7, appropriately shaped ends of the flexible outer and inner boards 42, 44 close both sides of the butt end 32.

Figure 8A:
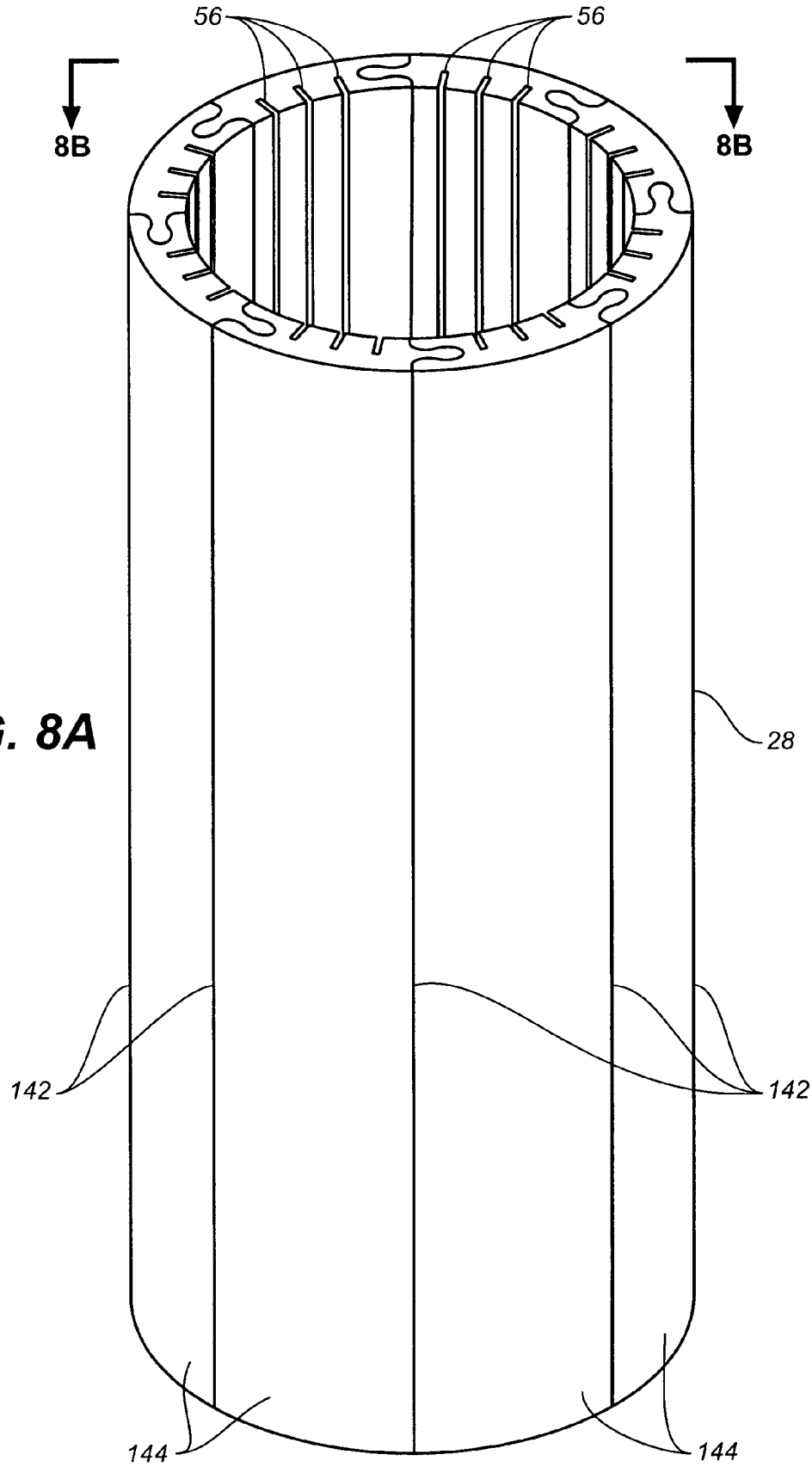
FIG. 8A is a perspective view of a column assembled from flexible boards that are joined to each other by tongue-and-groove joints.
Figure 8B:
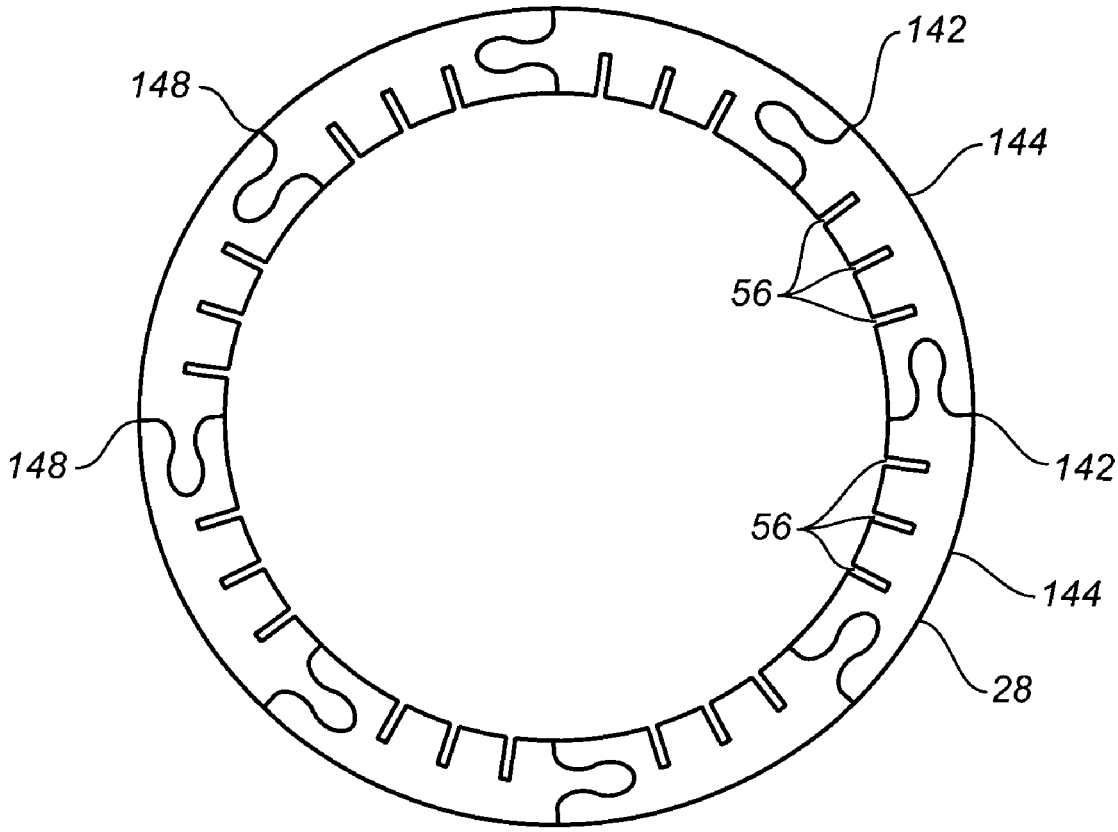
FIG. 8B is a plan view of the column depicted in FIG. 8A taken along the line 8B-8B.

If instead of cutting slots 56 transversely to boards of the wood-alternative material, slots 56 are cut longitudinally along boards of the wood-alternative material, as depicted in FIGS. 8A and 8B, such boards may be used for forming the columns 28. In FIGS. 8A and 8B, serrulated slots 56 are cut parallel to longitudinal edges 142 of boards 144. The column 28 is assembled by mating tongue-and-groove joints 148 formed along longitudinal edges 142 of immediately adjacent boards 144. A curved cutter portion of a router bit used to cut the tongue-and-groove joints 148 into mating longitudinal edges 142 of adjacent boards 144 may have the same shape as that depicted in FIG. 6 and described above.

Although the present invention has been described in terms of the presently preferred embodiment, it is to be understood that such disclosure is purely illustrative and is not to be interpreted as limiting. For example, the tracks 52 of the flexible outer board 42 and of the flexible inner board 44 may be formed during extrusion rather than by routing. Similarly, the tongue-and-groove 62, the second tongue-and-groove 64 and/or the tongue-and-grooves 72 may be formed on the arcuate tiles 46 and 48 by molding rather than by routing. Consequently, without departing from the spirit and scope of the invention, various alterations, modifications, and/or alternative applications of the invention will, no doubt, suggest themselves to those skilled in the art after having read the preceding disclosure. Accordingly, it is intended that the following claims be interpreted as encompassing all alterations, modifications, or alternative applications as fall within the true spirit and scope of the invention.

What is claimed is:

1. An arcuate architectural component adapted for inclusion in an architectural structure, the arcuate architectural component comprising:

a flexible outer board that upon being bent forms a curved first outer surface of the arcuate architectural component, said flexible outer board including tongue-and-groove tracks formed along opposite longitudinal edges thereof;

a flexible inner board that upon being bent forms a curved second outer surface of the arcuate architectural component, said flexible inner board including tongue-and-groove tracks formed along opposite longitudinal edges thereof;

a first plurality of arcuate tiles that are adapted to be arranged for forming a third outer surface of the arcuate architectural component which spans between a longitudinal edge of said flexible outer board and a longitudinal edge of said flexible inner board, each of said first plurality of arcuate tiles having formed along peripheral edges thereof:

an arcuate first tongue-and-groove that is adapted to mate and lock with a portion of the tongue-and-groove track of said flexible outer board; and an arcuate second tongue-and-groove that is adapted to mate and lock with a portion of the tongue-and-groove track of said flexible inner board;

whereby said first plurality of arcuate tiles, when all mated and locked with the tongue-and-groove tracks of said flexible outer board and with said flexible inner board form the third outer surface of the arcuate architectural component, said first plurality of arcuate tiles constraining the mating tongue-and-groove tracks of said flexible outer board and of said flexible inner board into an arcuate shape; and a second plurality of arcuate tiles that are adapted to be arranged for forming a fourth outer surface of said flexible outer board which spans between a longitudinal edge of said flexible outer board and a longitudinal edge of said flexible inner board, each of said second plurality of arcuate tiles having formed along peripheral edges thereof:

an arcuate first tongue-and-groove that is adapted to mate and lock with a portion of the tongue-and-groove track of said flexible outer board; and an arcuate second tongue-and-groove that is adapted to mate and lock with a portion of the tongue-and-groove track of said flexible inner board;

whereby said second plurality of arcuate tiles, when all mated and locked with the tongue-and-groove tracks of said flexible outer board and with said flexible inner board form the fourth outer surface of the arcuate architectural component, said second plurality of arcuate tiles constraining the mating tongue-and-groove tracks of said flexible outer board and of said flexible inner board into an arcuate shape.

2. The arcuate architectural component of claim 1 wherein:

said first plurality of arcuate tiles have a third tongue-and-groove formed along a peripheral edge thereof which spans between the first and the second tongue-and-grooves of said tiles, when said first plurality of arcuate tiles are assembled into said arcuate architectural component the third tongue-and-grooves of immediately adjacent tiles mating and locking together; and said second plurality of arcuate tiles have a third tongue-and-groove formed along a peripheral edge thereof which spans between the first and the second tongue-and-grooves of said tiles, when said second plurality of arcuate tiles are assembled into said arcuate architectural component the third tongue-and-grooves of immediately adjacent tiles mating and locking together.

3. The arcuate architectural component of claim 1 wherein pairs of tiles, a first tile of each pair belonging to said first plurality of arcuate tiles and a second tile of each pair belonging to said second plurality of arcuate tiles, are formed as mirror images.

4. The arcuate architectural component of claim 1 wherein:

said flexible outer board also includes a series of serrulate slots that extend well into said flexible outer board, the slots extending transversely across said flexible outer board between the tongue-and-groove tracks formed along opposite longitudinal edges thereof to facilitate bending of said flexible outer board; and said flexible inner board also includes a series of serrulate slots that extend well into said flexible inner board, the slots extending transversely across said flexible inner board between the tongue-and-groove tracks formed along opposite longitudinal edges thereof to facilitate bending of said flexible inner board.

5. The arcuate architectural component of claim 1 wherein said flexible outer board, said flexible inner board, said first plurality of arcuate tiles and said second plurality of arcuate tiles are all formed from a solid plastic, wood-alternative material.

6. An arcuate architectural component adapted for inclusion in an architectural structure, the arcuate architectural component comprising:

a plurality of flexible boards each of which includes tongue-and-groove tracks formed along opposite longitudinal edges thereof, each tongue-and-groove track of each flexible board being adapted to mate together with and lock with one of the tongue-and-groove tracks formed along the longitudinal edge of the immediately adjacent flexible board when said flexible boards are assembled to form said second arcuate architectural component;

whereby when said flexible boards are bent parallel to the tongue-and-groove tracks thereof and tongue-and-groove tracks of all flexible boards are all mated and locked with the tongue-and-groove tracks of immediately adjacent flexible boards the assembled flexible boards form a column.

7. The arcuate architectural component of claim 6 wherein said flexible boards also include a series of serrulate slots that extend well into said flexible boards, the slots extending longitudinally along said flexible board between the tongue-and-groove tracks formed along opposite longitudinal edges thereof to facilitate bending of said flexible boards.

8. The arcuate architectural component of claim 6 wherein said flexible boards are formed from a solid plastic, wood-alternative material.

9. An architectural structure that includes an arcuate component, the arcuate architectural component comprising:

a flexible outer board that upon being bent forms a curved first outer surface of the arcuate architectural component, said flexible outer board including tongue-and-groove tracks formed along opposite longitudinal edges thereof;

a flexible inner board that upon being bent forms a curved second outer surface of the arcuate architectural component, said flexible inner board including tongue-and-groove tracks formed along opposite longitudinal edges thereof;

a first plurality of arcuate tiles that are adapted to be arranged for forming a third outer surface of the arcuate architectural component which spans between a longitudinal edge of said flexible outer board and a longitudinal edge of said flexible inner board, each of said first plurality of arcuate tiles having formed along peripheral edges thereof:

an arcuate first tongue-and-groove that is adapted to mate and lock with a portion of the tongue-and-groove track of said flexible outer board; and an arcuate second tongue-and-groove that is adapted to mate and lock with a portion of the tongue-and-groove track of said flexible inner board;

whereby said first plurality of arcuate tiles, when all mated and locked with the tongue-and-groove tracks of said flexible outer board and with said flexible inner board form the third outer surface of the arcuate architectural component, said first plurality of arcuate tiles constraining the mating tongue-and-groove tracks of said flexible outer board and of said flexible inner board into an arcuate shape; and a second plurality of arcuate tiles that are adapted to be arranged for forming a fourth outer surface of said flexible outer board which spans between a longitudinal edge of said flexible outer board and a longitudinal edge of said flexible inner board, each of said second plurality of arcuate tiles having formed along peripheral edges thereof:

an arcuate first tongue-and-groove that is adapted to mate and lock with a portion of the tongue-and-groove track of said flexible outer board; and an arcuate second tongue-and-groove that is adapted to mate and lock with a portion of the tongue-and-groove track of said flexible inner board;

whereby said second plurality of arcuate tiles, when all mated and locked with the tongue-and-groove tracks of said flexible outer board and with said flexible inner board form the fourth outer surface of the arcuate architectural component, said second plurality of arcuate tiles constraining the mating tongue-and-groove tracks of said flexible outer board and of said flexible inner board into an arcuate shape.

10. The architectural structure that includes an arcuate component of claim 9 wherein:

said first plurality of arcuate tiles have a third tongue-and-groove formed along a peripheral edge thereof which spans between the first and the second tongue-and-grooves of said tiles, when said first plurality of arcuate tiles are assembled into said arcuate architectural component the third tongue-and-grooves of immediately adjacent tiles mating and locking together; and said second plurality of arcuate tiles have a third tongue-and-groove formed along a peripheral edge thereof which spans between the first and the second tongue-and-grooves of said tiles, when said second plurality of arcuate tiles are assembled into said arcuate architectural component the third tongue-and-grooves of immediately adjacent tiles mating and locking together.

11. The architectural structure that includes an arcuate component of claim 9 wherein pairs of tiles, a first tile of each pair belonging to said first plurality of arcuate tiles and a second tile of each pair belonging to said second plurality of arcuate tiles, are formed as mirror images.

12. The architectural structure that includes an arcuate component of claim 9 wherein:

said flexible outer board also includes a series of serrulate slots that extend well into said flexible outer board, the slots extending transversely across said flexible outer board between the tongue-and-groove tracks formed along opposite longitudinal edges thereof to facilitate bending of said flexible outer board; and said flexible inner board also includes a series of serrulate slots that extend well into said flexible inner board, the slots extending transversely across said flexible inner board between the tongue-and-groove tracks formed along opposite longitudinal edges thereof to facilitate bending of said flexible inner board.

13. The architectural structure that includes an arcuate component of claim 9 wherein said flexible outer board, said flexible inner board, said first plurality of arcuate tiles and said second plurality of arcuate tiles are all formed from a solid plastic, wood-alternative material.

14. The architectural structure that includes an arcuate component of claim 9 further comprising a second arcuate architectural component, the second arcuate architectural component including:

a plurality of flexible boards each of which includes tongue-and-groove tracks formed along opposite longitudinal edges thereof, each tongue-and-groove track of each flexible board being adapted to mate together with and lock with one of the tongue-and-groove tracks formed along the longitudinal edge of the immediately adjacent flexible board when said flexible boards are assembled to form said second arcuate architectural component;

whereby when said flexible boards are bent parallel to the tongue-and-groove tracks thereof and tongue-and-groove tracks of all flexible boards are all mated and locked with the tongue-and-groove tracks of immediately adjacent flexible boards the assembled flexible boards form a column.

15. The architectural structure that includes an arcuate component of claim 14 wherein said flexible boards also include a series of serrulate slots that extend well into said flexible boards, the slots extending longitudinally along said flexible board between the tongue-and-groove tracks formed along opposite longitudinal edges thereof to facilitate bending of said flexible boards.

16. The architectural structure that includes an arcuate component of claim 14 wherein said flexible boards are formed from a solid plastic, wood-alternative material.

17. An architectural structure that includes an arcuate component, the arcuate architectural component comprising:

a plurality of flexible boards each of which includes tongue-and-groove tracks formed along opposite longitudinal edges thereof, each tongue-and-groove track of each flexible board being adapted to mate together with and lock with one of the tongue-and-groove tracks formed along the longitudinal edge of the immediately adjacent flexible board when said flexible boards are assembled to form said arcuate architectural component;

whereby when said flexible boards are bent parallel to the tongue-and-groove tracks thereof and tongue-and-groove tracks of all flexible boards are all mated and locked with the tongue-and-groove tracks of immediately adjacent flexible boards the assembled flexible boards form a column.

18. The architectural structure that includes an arcuate component of claim 17 wherein said flexible boards also include a series of serrulate slots that extend well into said flexible boards, the slots extending longitudinally along said flexible board between the tongue-and-groove tracks formed along opposite longitudinal edges thereof to facilitate bending of said flexible boards.

19. claim The architectural structure that includes an arcuate component of claim 17 wherein said flexible boards are formed from a solid plastic, wood-alternative material.

* * * * *